US005236103A

United States Patent [19]

Ficken et al.

[11] Patent Number: 5,236,103

[45] Date of Patent: Aug. 17, 1993

[54] FOOD MODULE

[75] Inventors: Leonard A. Ficken, Manchester; Donald G. Hovinga, St. Charles, both of Mo.

[73] Assignee: Unidynamics Corporation, New York, N.Y.

[21] Appl. No.: 769,558

[22] Filed: Oct. 1, 1991

[51] Int. Cl.[5] ..... G07F 11/00

[52] U.S. Cl. ..... 221/124; 221/129; 221/133; 221/150 R; 221/194

[58] Field of Search ..... 221/75, 150 R, 155, 221/123, 124, 125, 129, 130, 131, 133, 287

[56] References Cited

U.S. PATENT DOCUMENTS

| | | | |
|---|---|---|---|
| 2,990,973 | 7/1961 | Chazen | 221/2 |
| 3,344,953 | 10/1967 | Krakauer et al. | 221/75 |
| 3,884,386 | 5/1975 | Urcola | 221/7 |
| 3,986,759 | 10/1976 | Holstein et al. | 312/265.6 |
| 4,512,453 | 4/1985 | Schuller et al. | 194/200 |
| 4,730,750 | 3/1988 | Ficken | 221/124 |
| 4,823,984 | 4/1989 | Ficken | 221/96 |
| 4,920,764 | 5/1990 | Martin | 62/259.1 |
| 4,986,441 | 1/1991 | Kanbe et al. | 221/130 |
| 5,121,854 | 6/1992 | Trouteaud et al. | 221/150 R X |

FOREIGN PATENT DOCUMENTS

| | | |
|---|---|---|
| 0244990 | 4/1987 | European Pat. Off. . |
| 0288142A | 3/1988 | European Pat. Off. . |
| 2209331A | 9/1987 | United Kingdom . |

*Primary Examiner*—David H. Bollinger

*Attorney, Agent, or Firm*—Senniger, Powers, Leavitt & Roedel

[57] ABSTRACT

A refrigerated food module stores and dispenses refrigerated foods from within a housing of a vending machine. The vending machine is of the type adapted for storing unrefrigerated foods and has a selection panel from which foods can be selected. The selected food is dispensed to a receiving device from which it can be retrieved by a customer. The refrigerated food module includes an insulated housing for containing the refrigerated foods and a self-contained refrigeration unit for cooling the insulated housing. Dispensing mechanisms are located in the insulated housing for dispensing a selected refrigerated food to the receiving device. A portion of the insulated housing is movable between a closed position in which it is in sealing engagement with the insulated housing and an open position in which the dispensing mechanisms in the insulated housing can dispense the refrigerated foods to the receiving device. The vending machine selection panel is interconnected with the dispensing mechanisms in the insulated housing so that a refrigerated food can be selected from the selection panel to be dispensed from the insulated housing. The movable portion of the insulated housing is moved to its open position when a refrigerated food is selected and returns to its closed position after the selected refrigerated food is dispensed from the insulated housing.

17 Claims, 6 Drawing Sheets

FOOD MODULE

BACKGROUND OF THE INVENTION

This invention relates to a refrigerated food module storage and dispensing apparatus for dispensing refrigerated foods, for example cold sandwiches or drinks, and/or frozen foods such as ice cream, from a vending machine. This invention further relates to a vending machine for dispensing refrigerated foods, and/or frozen foods, and unrefrigerated foods such as packaged snacks.

It is generally known that vending machines can provide a refrigerated section to keep products cold. For example, food vending machines are known for dispensing sandwiches or cold drinks by inserting coins or bills. It is also generally known to provide vending machines which dispense products which are not refrigerated. For example, candy or snack food packages are generally kept in a non-refrigerated vending machine. Very often it is desired to have both unrefrigerated and refrigerated foods dispensed and at the same physical location, such as in an employee kitchen. However, it is impractical due to space limitations to use both a refrigerated vending machine and an unrefrigerated vending machine. It is also impractical to exchange an entire non-refrigerated vending machine for an entire vending machine with refrigerated and unrefrigerated sections. Therefore, there is a need for a machine for dispensing refrigerated and non-refrigerated foods.

Coassigned U.S. Pat. No. 4,730,750 suggests a vending machine for dispensing refrigerated and unrefrigerated foods in which a separate housing within a vending machine has a door with spring means through which refrigerated products are dispensed. Coassigned U.S. Pat. No. 4,823,984 discloses a container storage and dispensing apparatus having an apparatus as found in U.S. Pat. No. 4,730,750 but also including a hot drink dispenser. However, the vending machine disclosed in these patents as well as presently available vending machines do not use a modular refrigerated storage and dispensing apparatus which may be transported to and installed in a variety of vending machines.

In addition, some presently available vending machines have refrigerated and unrefrigerated sections or areas, but require all the dispensed products to pass through both the refrigerated and unrefrigerated sections prior to dispensing. In these vending machines it is not possible to independently or separately dispense the product from the refrigerated and unrefrigerated sections.

Present vending machines are also available in which the selected foods are dispensed to separate receivers depending on whether or not they are refrigerated, thus, adding to the customer's inconvenience.

Other presently available vending machines as well as the incorporated vending machines have limited flexibility as to which types of products may be dispensed, for example, only beverage cans or a certain size of refrigerated snack. In these machines it is not possible, for example, to dispense a cold sandwich, a cold beverage, and a room temperature package of chips to a common receiving area from a single vending machine.

Very often the use of the non-refrigerated vending machine results in the candy or the like being destroyed because of melting, thus resulting in customer dissatisfaction or loss of the product. Because many unrefrigerated foods are most palatable at a temperature most near room temperature, it is generally not desirable to refrigerate this product at or near a temperature for which refrigerated foods are enjoyed. Therefore it is undesirable, for example, to place candy or the like in a refrigerated machine since these machines typically cool to around 35–45 F. It is also desirable to have a refrigerated area within an unrefrigerated vending machine capable of storing and dispensing a variety of refrigerated foods. It is also desirable that existing unrefrigerated machines be easily converted to have a refrigerated area.

SUMMARY OF THE INVENTION

Among the several objects of the invention may be noted the provision of a food module permitting the dispensing of refrigerated product and unrefrigerated product from a single vending machine; the provision of such food module which permits installation in a variety of vending machines; the provision of such food module which operates from the microprocessor of the vending machine in which it is installed so that there is a single selection control for choosing refrigerated and/or unrefrigerated product; the provision of such food module which permits variably shaped and sized refrigerated products to be dispensed; the provision of such food module which is suitable for locations having space limitations; the provision of such food module which permits the independent and separate dispensing of refrigerated and unrefrigerated product from the vending machine; the provision of such food module which partially cools product in the unrefrigerated section of the vending machine; and the provision of such food module which is economically feasible and commercially practical.

Briefly described, a refrigerated food module of the present invention is for storing refrigerated foods and for dispensing the refrigerated foods from within a housing of a vending machine. The vending machine is of the type adapted for storing unrefrigerated foods and has means for selecting one of the foods to be dispensed and means for dispensing the selected food to a receiving device from which a customer can retrieve the selected food. The invention includes an insulated housing for containing the refrigerated foods and means for cooling the insulated housing. Means in the insulated housing dispense a selected refrigerated food therefrom. Means forming a portion of the insulated. housing is translationally movable between a closed position in which it is in sealing engagement with the insulated housing and an open position. The dispensing means in the insulated housing can dispense the refrigerated foods to the receiving device when the translationally movable means is in its open position Means interconnect the selecting means of the vending machine with the dispensing means in the insulated housing so that the selecting means causes the dispensing means in the insulated housing to dispense a selected refrigerated food. The interconnecting means causes movement of the translationally movable means from its closed position to its open position for dispensing the selected refrigerated food from the insulated housing and then causes the translationally movable means to return to its closed position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
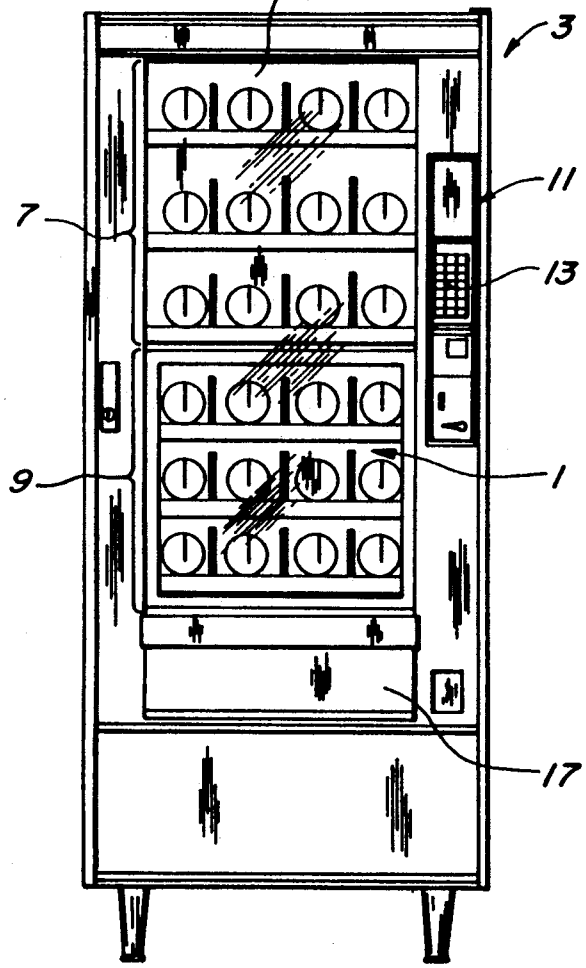
FIG. 1 is a front view of a food module in accordance with the present invention shown in a vending machine.

In FIG. 1 the food module 1 of the present invention is shown mounted in a vending machine 3. The vending machine 3 has a door 5 having a clear see-through panel for displaying foods in the vending machine. Unrefrigerated foods, such as candy or food packages, are displayed in the vending machine 3 in an unrefrigerated food storage and dispensing area 7 outside of the module 1. Analogously, refrigerated foods, such as cold sandwiches or drinks, are displayed in a refrigerated food storage and dispensing area 9 inside the module 1. The vending machine 3 has a selection panel 11 having a plurality of push button switches 13 corresponding to a respective dispenser in either the unrefrigerated or refrigerated storage and dispensing areas 7 and 9. The selection panel 11 includes a vendor control and selection system which operates through a microprocessors 14 shown in block form in FIG. 2 as described in U.S. Pat. No. 4,512,453, which is incorporated herein by reference. Money is inserted in the selection panel 11 and when a proper amount is inserted, push button switches 13 may be operated. In response to the pushed switch 13, refrigerated or unrefrigerated foods are dispensed to a common receiving device 15 which is accessible through a vending drawer door 17 in the vending machine door 5. The selection panel 11 is an example of means for selecting one of the foods to be dispensed.

Figure 2:
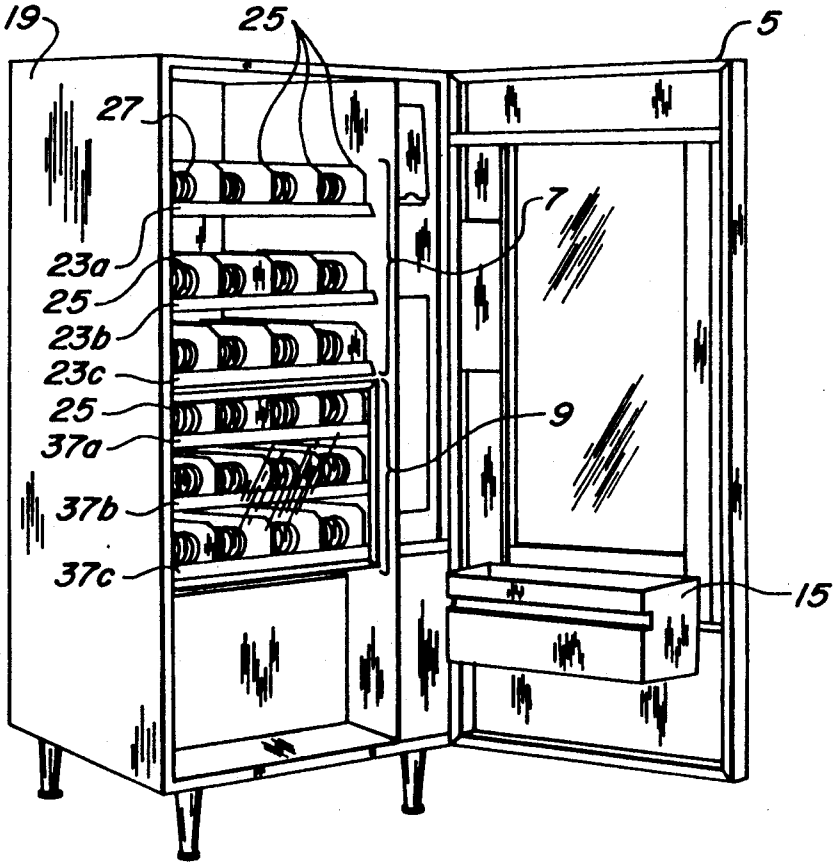
FIG. 2 is a perspective view of the food module of FIG. 1 shown in the vending machine with a door open.

As may best be seen in FIG. 2, the vending machine door 5 is mounted on an exterior housing 19 and may be opened for access to the interior of the vending machine 3 which includes both the unrefrigerated storage and dispensing area 7 and the module 1. The module 1 has an insulated housing 21 for containing the refrigerated foods and is mounted within the exterior housing 19.

The unrefrigerated storage and dispensing area 7 has three shelves 23*a*, 23*b* and 23*c*. Each of the shelves 23 has separators 25 between spiral arms 27 in which the unrefrigerated foods such as candy bars or snack food packages are placed. The spiral arms 27 are rotated by motors (not shown) in response to a machine controller as shown in FIG. 1 of U.S. Pat. No. 4,512,453 for dispensing the unrefrigerated foods. A dispenser having spiral arms for dispensing food packages is shown in U.S. Pat. No. 3,986,759, which is incorporated herein by reference. The incorporation of spiral arms 27 should not be interpreted in a limiting sense as there are a variety of dispensing mechanisms available for both the unrefrigerated and refrigerated storage and dispensing areas 7 and 9, including a pusher mechanism or a continuous belt mechanism.

Figure 6:
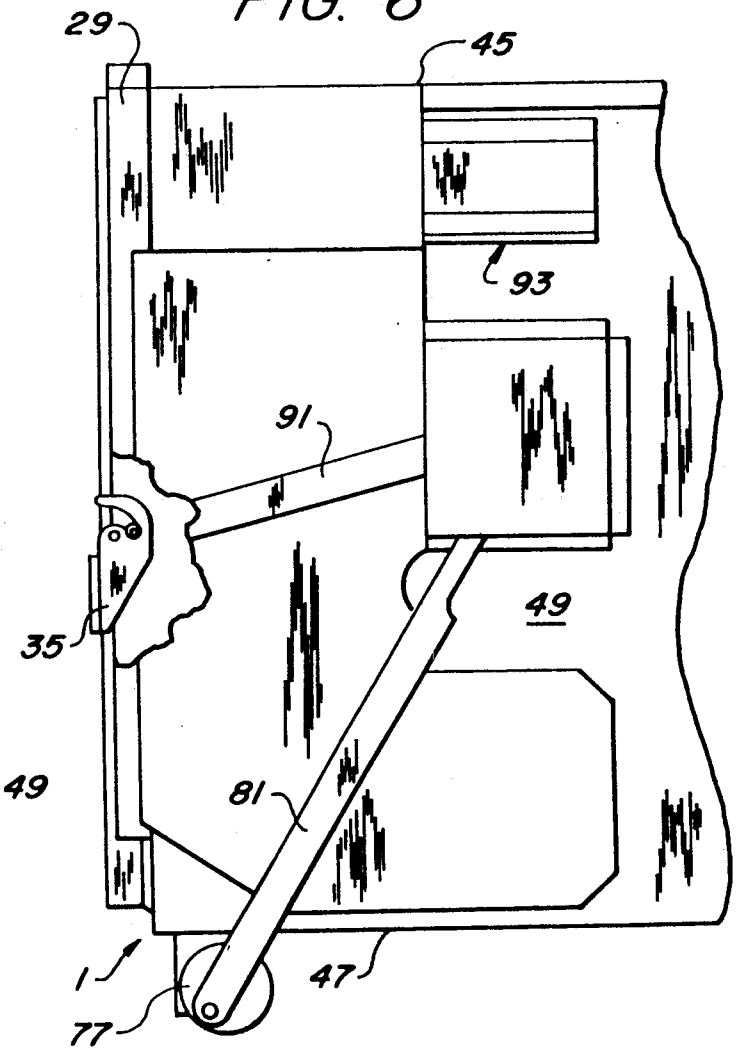
FIG. 6 is an enlarged and fragmentary side view of the food module with a portion broken away to show detail thereof.
Figure 5:
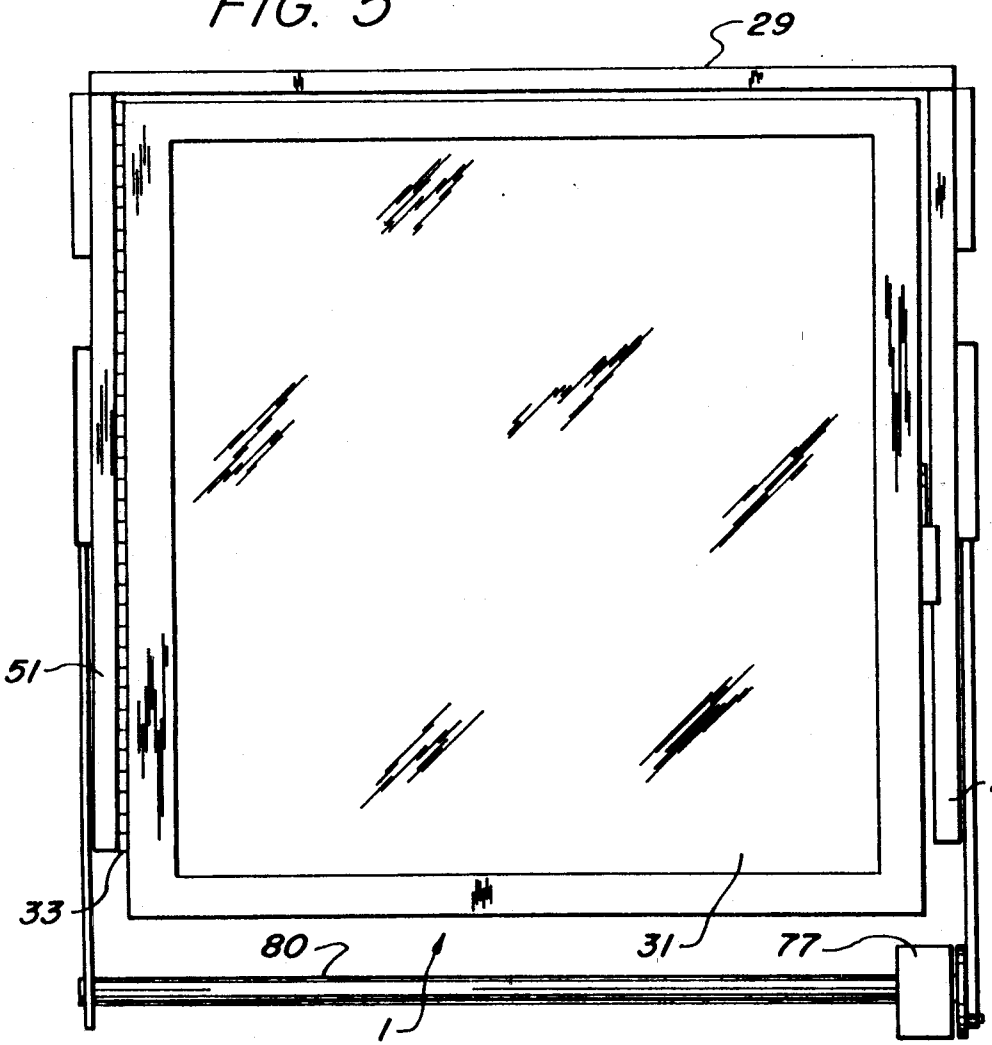
FIG. 5 is an enlarged front view of the front panel of the food module.

The module 1 includes a front panel 29 covering an opening for inserting and dispensing the refrigerated foods to and from, respectively, the refrigerated food storage and dispensing area 9. The front panel 29 has a clear, continuous window 31 so the customer can view the refrigerated foods. As shown in FIG. 5, the window 31 is attached to the front panel 29 on a strip hinge 33 allowing the window 31 to swing open. The window 31 swings open to allow stocking foods within the refrigerated storage and dispensing area 9. A latch 35, as shown in FIG. 6, is used to keep the window 31 closed in sealing engagement with the front panel 29 during normal operation of the vending machine 3 and module 1. The front panel 29 having the hinged window 31 thus constitutes means forming a portion of the insulated housing 21.

The module 1 has three shelves 37*a*, 37*b* and 37*c* for storing the refrigerated foods. The shelves 37 may each be removed or positioned at various heights within the module 1 allowing for a variety of foods to be stored and dispensed. Each of the shelves 37 has a dispensing mechanism similar to the vending machine 3 dispensing mechanism, such as spiral arms 39. The spiral arms 39 are an example of means in the insulated housing 21 for dispensing a selected refrigerated food therefrom.

Figure 3:
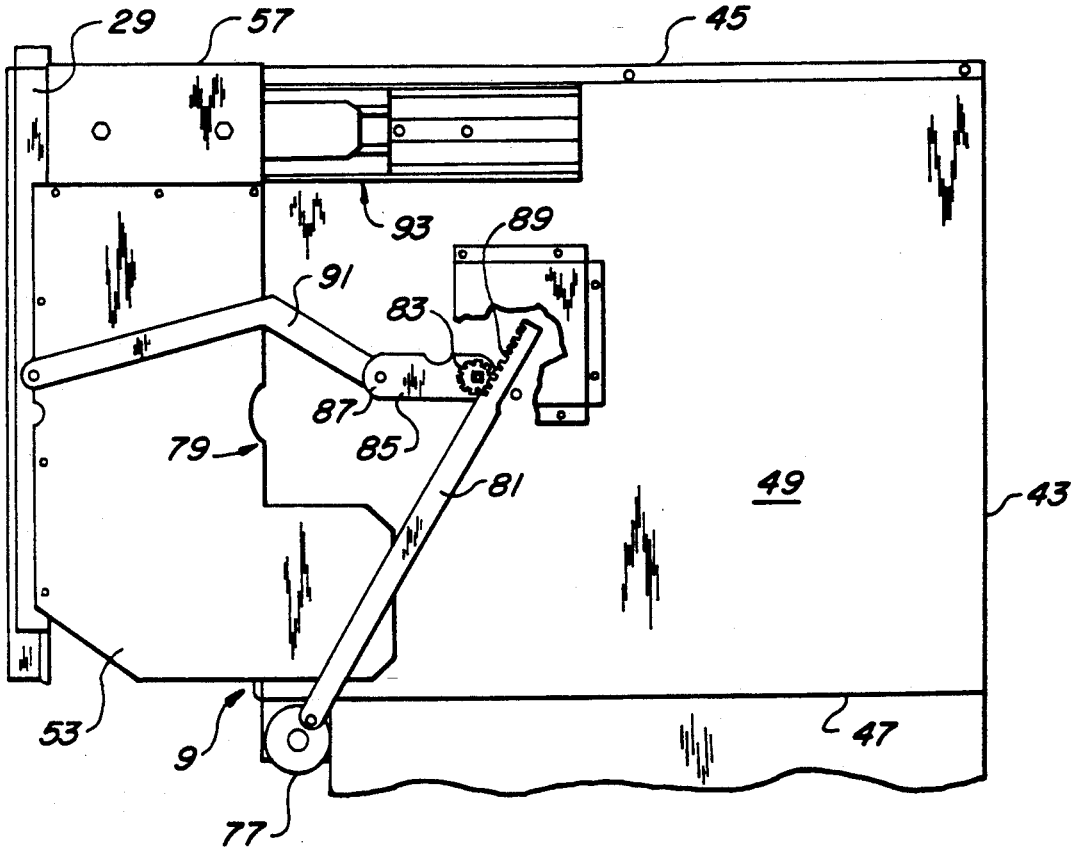
FIG. 3 is an enlarged and fragmentary side view of the food module with a front panel in an open position with a portion broken away to show detail thereof.
Figure 4:
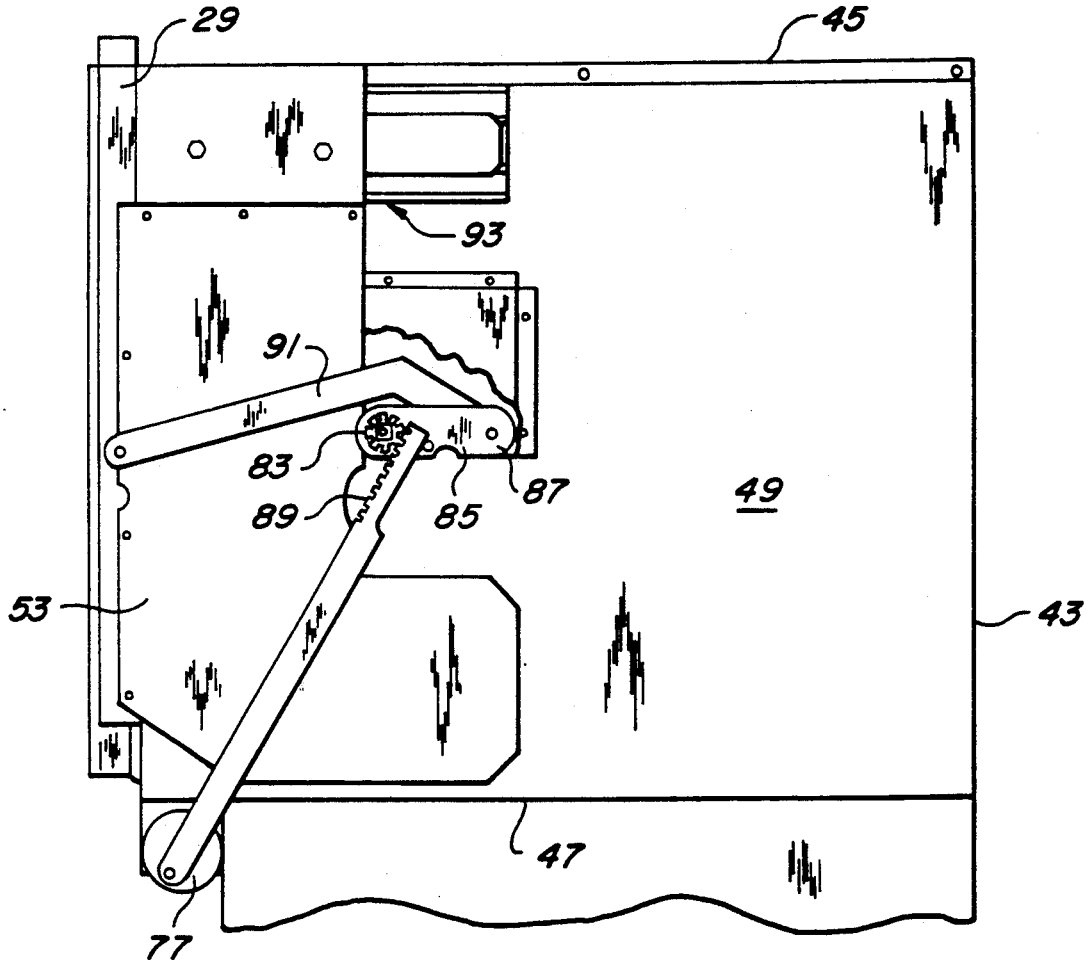
FIG. 4 is an enlarged and fragmentary side view of the food module with the front panel in a closed position with a portion broken away to show detail thereof.

The front panel 29 has an open position (as shown in FIG. 3) and a closed position (as shown in FIG. 4). The closed position is in sealing engagement with the rest of the insulated housing 21. While dispensing the selected refrigerated food, the front panel 29 is in its open position. The front panel 29 then returns to its closed position after the dispensing operation is completed. The front panel 29 tends to be pressed against gaskets 41 in its closed position.

The insulated housing 21 includes a rear panel 43, a top panel 45 and a bottom panel 47. The top panel 45 and bottom panel 47 are secured to side panels 49 and 51 and the rear panel 43. The front panel 29 has additional side panels 53 and 55 and a top panel 57 which overlap the side panels 49 and 51 and the top panel 45 of the insulated housing 21. Thus, the only access to the refrigerated storage and dispensing area 9 when the front panel 29 is in its open position is from the bottom of the front panel 29.

Figure 7:
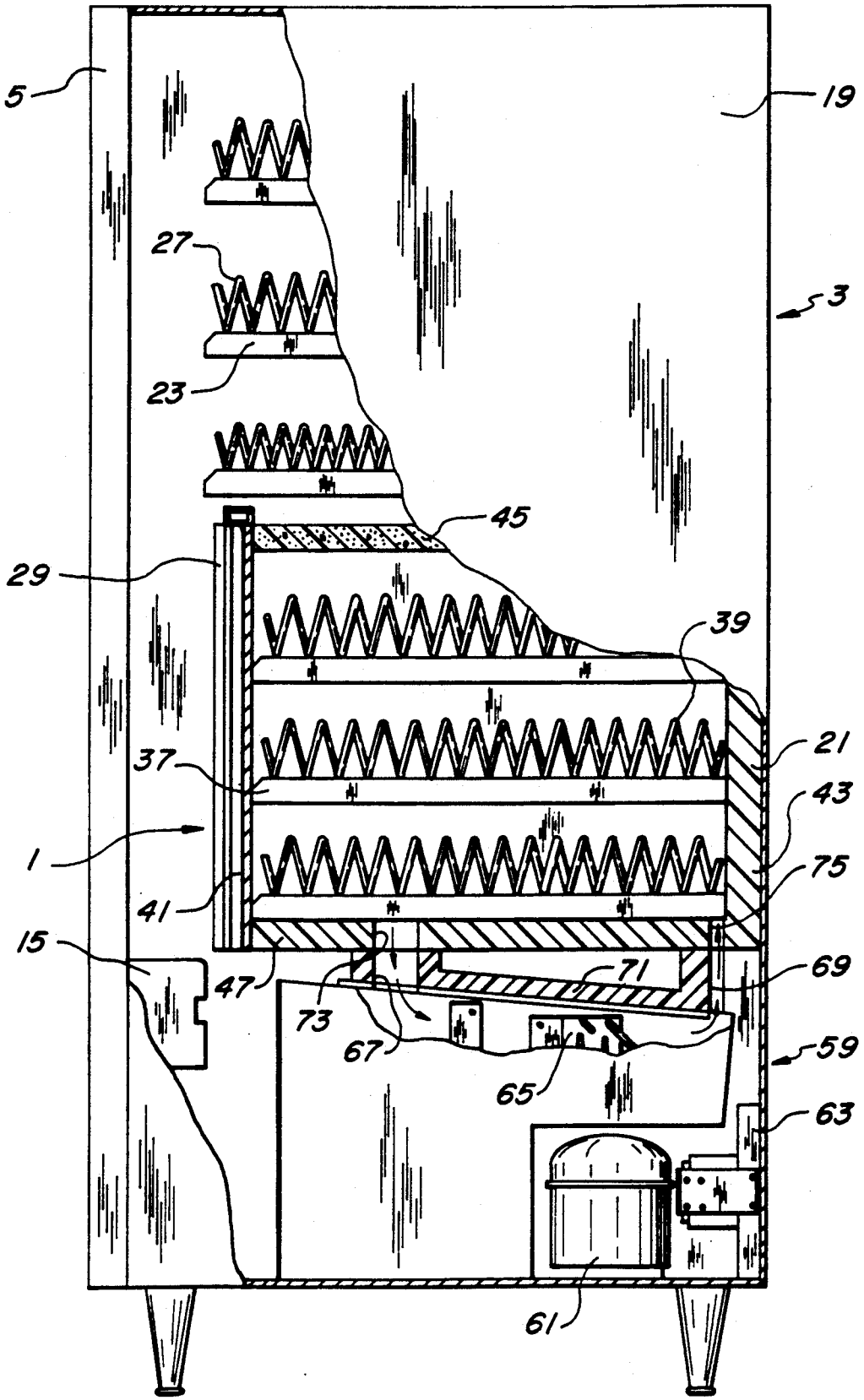
FIG. 7 is an enlarged side-view of the vending machine and a partially cross-sectional side view of the food module with portions broken away to show detail thereof.

As may best be seen in FIG. 7, a self-contained refrigeration unit 59 and housing is mounted adjacent the insulated housing 21. The refrigeration unit 59 includes a compressor 61 and condenser coils 63. Cooling or evaporator coils 65 of the refrigeration unit 59 are in an insulated area. There are two openings 67 and 69 formed in a single foam plastic member 71. These two openings 67 and 69 in the refrigeration unit 59 match openings 73 and 75 in the bottom panel 47 and the piece of insulating material and constitute an intake vent 73 and an outtake vent 75. A motor driven fan (not shown) forces air over the cooling coils 65 and out the outtake vent 75 into the refrigerated storage and dispensing area 9. The air supplied to the refrigerated storage and dispensing area 9 is preferably sufficient to cool the temperature to around 45 F. Cool air thus circulates forwardly out the outtake vent 75, through the insulated housing 21 and back through the intake vent 73 supplying air to the fan. The refrigerator unit 59 thus constitutes means for cooling the insulated housing 21. The refrigeration unit 59 is adaptable for maintaining temperatures within the insulated housing 21 at which frozen foods may be stored in the module 1.

The operation and use of the vending machine 3 and module 1 will now be described. With the vending machine door 5 open as shown in FIG. 2 the unrefrigerated foods may be placed between the spiral arms 27 in the unrefrigerated food storage and dispensing area 7. Because the door is clear, different types of the foods may be mixed on each spiral arm 27. The refrigerated food may be conveniently stored in the module 1 in a like manner.

Money is inserted into the selection panel 11 and when the proper amount is inserted, the push-button switches 13 on the panel 11 will permit dispensing. The customer may conveniently select the food for dispensing since both the unrefrigerated foods in the unrefrigerated food storage and dispensing area 7 and the refrigerated foods in the refrigerated food storage and dispensing area 9 are visible through the vending machine door 5. The refrigerated food may be identified through the window 31 in the front panel 29. As previously discussed the vendor control and selection system described in U.S. Pat. No. 4,512,453 is used for controlling dispenser motors for both the refrigerated and unrefrigerated foods. The selection panel 11 thus constitutes means for selecting one of the foods to be dispensed to the common receiving device 15.

If an unrefrigerated food is selected for dispensing, the motor connected to one of the spiral arms 27 will respond by rotating, thus forcing the food to be pushed off the shelf. The unrefrigerated food package will then fall into the common receiving device 15 for retrieval by the customer.

Referring to FIG. 3, if a refrigerated food is selected for dispensing, a motor 77 will move the front panel 29 to its open position. The motor connected to one of the spiral arms 39 will respond by rotating, thus forcing the food to be pushed off the shelf 37. The refrigerated food package will then fall into the common receiving device 15 for retrieval by the customer. The front panel 29 then returns to its closed position. The front panel 29 is moved between its closed and open positions by a drive assembly 79 mounted on one side panel 49 of the insulated housing 21. The drive assembly 79 includes a drive member 81 which engages a gear 83. The gear 83 is mounted with a radius bar 85 having a distal end 87. As the drive member 81 is moved, gear teeth 89 engage the gear 83, rotating the radius bar 85 forwardly or rearwardly. The radius bar 85 is pivotally attached at its distal end 87 to a connecting arm 91 which is pivotally attached to one side of the front panel 29. The forward rotation of the radius bar 85 causes the connecting arm 91 to move the front panel 29 forwardly to its open position along a guide track 93. The rearward rotation of the radius bar 85 causes the connecting arm 91 to move the front panel 29 rearwardly to its closed position along the guide track 93. The connecting arm 91 is offset to allow sealing the front panel 29 against the gaskets 41 in the closed position. The drive assembly 79 is actuated by motor means 77. The drive assembly 79 and motor means 77 thus constitute means for moving the front panel 29. A second drive assembly corresponding to the drive assembly 79 is mounted on the side panel 51 and is driven by motor 77 through rod 80.

Figure 8:
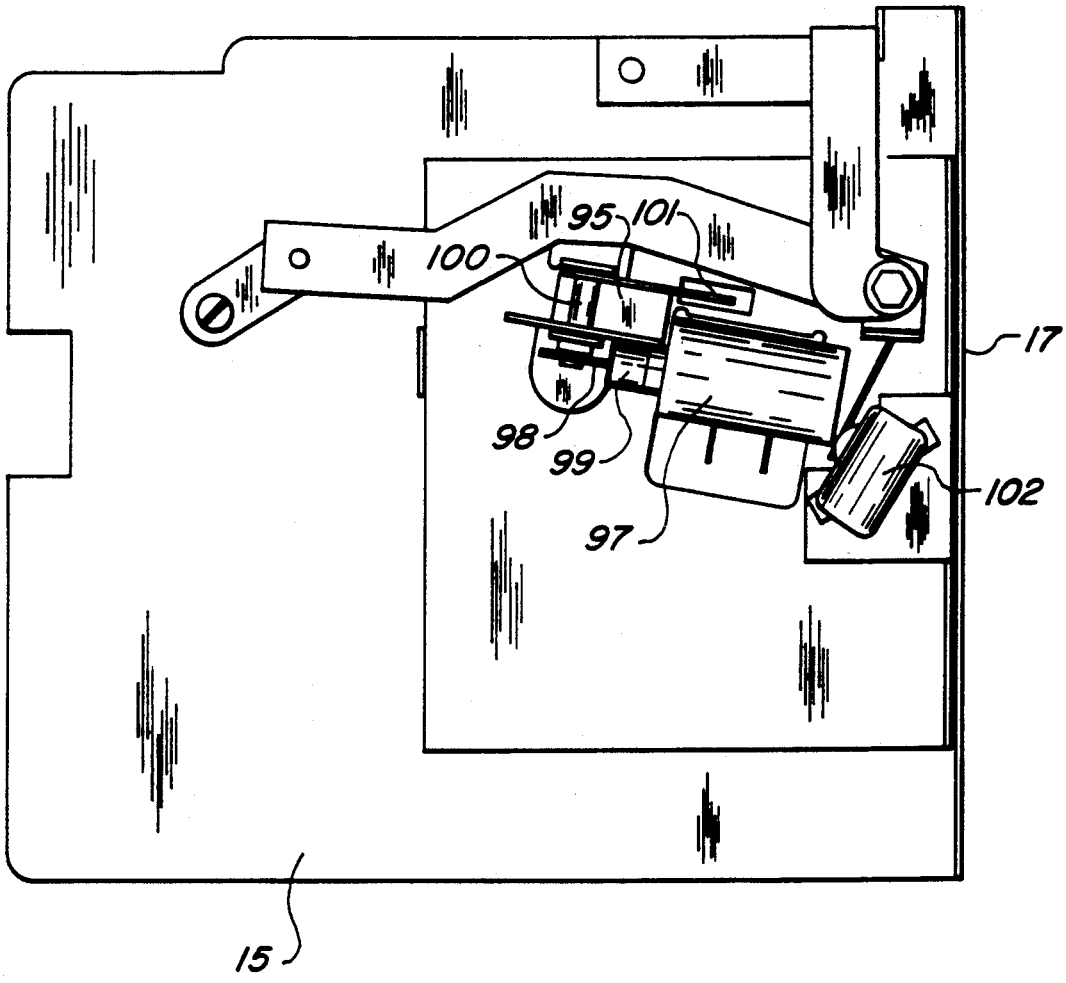
FIG. 8 is an enlarged side view of a vending machine receiving device.

The common receiving device 15 has a door 17 through which the customer can retrieve the dispensed foods. The receiving device door 17 is provided a lock member 95, as shown in FIG. 8, which is pivoted by a solenoid switch 97 by engaging end 98 of member 95 which pivots member 95 about pin 100 and thus causes the opposite end 101 to move into the path of movement of door 17. If the front panel 29 is in its open position and the customer attempts to move the receiving device door 17 microswitch 102 is activated and sends a signal to the microprocessor 14 which is turn activates the solenoid 97. If, however, the front panel 29 has not been opened solenoid 97 will not be activated to lock door 17. Door 17 is thus only locked when panel 29 is being opened. This is above in order to prevent possible jamming of the mechanism which moves panel 29 and for preventing access to the lower shelves in the module by reaching through the door 17 when panel 29 is open.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A refrigerated food module for storing refrigerated foods and for dispensing the refrigerated foods from within a housing of a vending machine of the type adapted for storing unrefrigerated foods, wherein the vending machine has means for selecting one of the foods to be dispensed and means for dispensing the selected food to a receiving device from which the selected food can be retrieved by a customer, the module comprising:

an insulated housing for containing the refrigerated foods;

means for cooling the insulated housing;

means in the insulated housing for dispensing a selected refrigerated food therefrom;

a panel forming a portion of the insulated housing and being translationally movable between a closed position in which the panel is in sealing engagement with the insulated housing and an open position in which the panel is spaced away from the insulated housing such that the dispensing means in the insulated housing can dispense the refrigerated foods to the receiving means; and wherein the selecting means causes the dispensing means in the insulated housing to dispense a selected refrigerated food by causing movement of the panel from its closed position to its open position for dispensing the selected refrigerated food from the insulated housing and then causing the panel to return to its closed position after the dispensing means in the insulated housing dispenses a selected refrigerated food.

2. A refrigerated food module as set forth in claim 1 wherein the panel has a window therein for viewing the refrigerated foods, the window being hingedly attached to the panel along one side of the panel and releasably latched to an opposite side of the panel.

3. A refrigerated food module as set forth in claim 2 further comprising means for moving the panel having:

first and second drive assemblies mounted on opposite sides of the insulated housing, each drive assembly including:

a drive member;

a gear fixedly mounted with a radius bar, the radius bar having a distal end which is rotated with the gear;

a connecting arm pivotally attached to the distal end of the radius bar and pivotally attached to one side of the panel;

a guide track; and motor means for actuating the first and second drive assemblies; and wherein the drive member is intermeshed with the gear such that the radius bar rotates forwardly as the drive member moves in one direction and the radius bar rotates rearwardly as the drive member moves in an opposite direction and wherein the connecting arm moves the panel forwardly along the guide track to its open position as the radius bar rotates forwardly and moves the panel rearwardly along the guide track to its closed position as the radius bar rotates rearwardly.

4. A refrigerated food module as set forth in claim 3 wherein the means for moving the panel seals the panel against a gasket surrounding an opening in the insulated housing when the panel is in its closed position.

5. A refrigerated food module as set forth in claim 1 wherein the cooling means forces cooled air forwardly through the insulated housing and intakes the cooled air rearwardly through an intake vent underneath the insulated housing for preventing undue cooling loss when the panel is in its open position.

6. A refrigerated food module as set forth in claim 1 wherein the cooling means is adaptable for maintaining temperatures at which frozen foods may be stored in the module.

7. A refrigerated food module as set forth in claim 1 wherein the vending machine receiving device has a door through which the customer can retrieve the dispensed foods, the door having locking means for preventing the door from being opened when the selected refrigerated food is being dispensed from the module.

8. A vending machine for dispensing refrigerated and unrefrigerated foods comprising:

a first housing means having an unrefrigerated storage and dispensing area for the unrefrigerated foods and a refrigerated storage and dispensing area for the refrigerated foods separate from the unrefrigerated storage and dispensing area;

means contained in the first housing means for cooling the refrigerated foods in the refrigerated storage and dispensing area;

common receiving means adjacent the refrigerated and unrefrigerated storage and dispensing areas for receiving dispensed foods form either area;

common means for selecting one of the refrigerated foods or unrefrigerated foods to be dispensed to the receiving means;

means responsive to the selecting means for dispensing the selected food to the receiving means; and a second housing means mounted within the first housing means for enclosing the refrigerated storage and dispensing area to contain the cooling, the second housing being insulated and having an opening therein and a panel slideably mounted over the opening, the panel being movable between an open position and a closed position.

9. A vending machine as set forth in claim 8 wherein the panel is translationally movable.

10. A vending machine as set forth in claim 8 wherein the panel has a window therein for viewing the refrigerated foods, the window being hingedly attached to the panel along one side of the panel and releasably latched to an opposite side of the panel.

11. A vending machine as set forth in claim 8 further comprising means for moving the panel, the moving means comprises:

first and second drive assemblies mounted on opposite sides of the second housing, each drive assembly including:

a drive member;

a gear fixedly mounted with a radius bar, the radius bar having a distal end;

a connecting arm pivotally attached to the distal end of the radius bar and pivotally attached to one side of the panel;

a guide track; and motor means for actuating the first and second drive assemblies; and wherein the drive member is intermeshed with the gear such that the radius bar rotates forwardly as the drive member moves in one direction and the radius bar rotates rearwardly as the drive member moves in an opposite direction and wherein the connecting arm moves the panel forwardly along the guide track to its open position as the radius bar rotates forwardly and moves the panel rearwardly along the guide track to its closed position as the radius bar rotates rearwardly.

12. A vending machine as set forth in claim 11 wherein the moving means seals the panel against a gasket surrounding the opening in the second housing when the panel is in its closed position.

13. A vending machine as set forth in claim 8 wherein the cooling means forces cooled air forwardly through the refrigerated storage and dispensing area and intakes the cooled air rearwardly through an intake vent underneath the refrigerated storage and dispensing area for preventing undue cooling loss when the panel is in its open position.

14. A vending machine as set forth in claim 8 wherein the cooling means is adaptable for maintaining temperatures at which frozen foods may be stored in the refrigerated storage and dispensing area.

15. A vending machine as set forth in claim 8 wherein the receiving means has a door through which the customer can retrieve the dispensed foods, the door having locking means for preventing the door from being opened when the selected refrigerated food is being dispensed from the module.

16. A refrigerated food module for storing refrigerated foods and for dispensing the refrigerated foods from within a housing of a vending machine of the type adapted for storing unrefrigerated foods, wherein the vending machine has means for selecting one of the foods to be dispensed and means for dispensing the selected food to a receiving device from which the selected food can be retrieved by a customer, the module comprising:

an insulated housing for containing the refrigerated foods;

means in the insulated housing for dispensing a selected refrigerated food therefrom;

a panel forming a portion of the insulated housing and being translationally movable between a closed position in which the panel is in sealing engagement with the insulated housing and an open position in which the panel is spaced away from the insulated housing such that the dispensing means in the insulated housing can dispense the refrigerated foods to the receiving device, the panel having a window therein for viewing the refrigerated foods, the window being hingedly attached to the panel along one side of the panel and releaseably latched to an opposite side of the panel;

means for cooling the insulated housing, the cooling means forcing cooled air forwardly through the insulated housing and intaking the cooled air rearwardly through an intake vent underneath the insulated housing for preventing undue cooling loss when the panel is in its open position and the cooling means being adaptable for maintaining temperatures at which frozen foods may be stored in the module;

the selecting means causes the dispensing means in the insulated housing to dispense a selected refrigerated food to the receiving device by causing movement of the panel from its closed position to its open position for dispensing the selected refrigerated food from the insulated housing and then causing the panel to return to its closed position after the dispensing means in the insulated housing dispenses a selected refrigerated food, the receiving device having a door through which the customer can retrieve the dispensed foods, the door having locking means for preventing the door from being opened when the selected refrigerated food is being dispensed from the module; and means for moving the panel, the means for moving the panel including first and second drive assemblies mounted on opposite sides of the insulated housing, each drive assembly including a drive member, a gear fixedly mounted with a radius bar, the radius bar having a distal end, a connecting arm pivotally attached to the distal end of the radius bar and pivotally attached to one side of the panel, a guide track, and motor means for actuating the first and second drive assemblies, and wherein the drive member is intermeshed with the gear such that the radius bar rotates forwardly as the drive member moves in one direction and the radius bar rotates rearwardly as the drive member moves in an opposite direction and wherein the connecting arm moves the panel forwardly along the guide track to its open position as the radius bar rotates forwardly and moves the panel rearwardly along the guide track to its closed position as the radius bar rotates rearwardly.

17. A vending machine for dispensing refrigerated and unrefrigerated foods comprising:

a first housing means having a refrigerated storage and dispensing area for the refrigerated foods separate from an unrefrigerated storage and dispensing area for the unrefrigerated foods;

means contained in the first housing means for cooling the refrigerated foods in the refrigerated storage and dispensing area, the cooling means forcing cooled air forwardly through the refrigerated storage and dispensing area and intaking the cooled air rearwardly through an intake vent underneath the refrigerated storage and dispensing area for preventing undue cooling loss and being adaptable for maintaining temperatures at which frozen foods may be stored in the refrigerated storage and dispensing area;

a second housing means for enclosing the refrigerated storage and dispensing area to contain the cooling, the second housing being insulated and having an opening therein and a panel slideably mounted over the opening, the panel being translationally movable between an open position and a closed position and having a window therein for viewing the refrigerated foods, the window being hingedly attached to the panel along one side of the panel and releaseably latched to an opposite side of the panel;

means for moving the panel, the moving means including first and second drive assemblies mounted on opposite sides of the second housing means, each drive assembly including a drive member, the drive member engaging a gear mounted with a radius bar having a distal end, the radius bar being rotated forwardly as the drive member moves in one direction, the radius bar being rotated rearwardly as the drive member moves in an opposite direction and including a connecting arm pivotally attached to the distal end of the radius bar and pivotally attached to one side of the panel, the connecting arm moving the panel forwardly along a guide track to its open position as the radius bar rotates forwardly and moving the front panel along the guide track to its closed position as the radius bar rotates rearwardly, and further including motor means for actuating the first and second drive assemblies, the moving means sealing the panel against a gasket surrounding the opening in the second housing when the panel is in its closed position;

common receiving means adjacent the refrigerated and unrefrigerated storage and dispensing areas for receiving dispensed foods from either area, the receiving means having a door through which the customer can retrieve the dispensed foods, the door having locking means for preventing the door from being opened when the selected refrigerated food is being dispensed from the module;

common means for selecting one of the refrigerated foods or unrefrigerated foods to be dispensed to the receiving means, the selecting means including a selection panel having a plurality of push button switches; and means responsive to the selecting means for dispensing the selected food to the receiving means.

* * * * *

UNITED STATES PATENT AND TRADEMARK OFFICE

CERTIFICATE OF CORRECTION

PATENT NO. : 5,236,103

DATED : August 17, 1993

INVENTOR(S) : Leonard A. Ficken et al.

It is certified that error appears in the above-identified patent and that said Letters Patent is hereby corrected as shown below:

Column 7, claim 8, line 58, "foods form either" should read ---foods from either---.

Signed and Sealed this

Twenty-sixth Day of April, 1994

*Attest:*

*Attesting Officer*

Bruce Lehman

BRUCE LEHMAN

*Commissioner of Patents and Trademarks*